US011299333B2

(12) United States Patent
O'Donnell et al.

(10) Patent No.: US 11,299,333 B2
(45) Date of Patent: Apr. 12, 2022

(54) FLEXIBLE PACKAGES WITH FLAT PANELS

(71) Applicant: The Procter & Gamble Company, Cincinnati, OH (US)

(72) Inventors: Hugh Joseph O'Donnell, Cincinnati, OH (US); Edward Daniel Theiss, III, Union Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 12 days.

(21) Appl. No.: 15/935,397

(22) Filed: Mar. 26, 2018

(65) Prior Publication Data

US 2018/0282041 A1 Oct. 4, 2018

Related U.S. Application Data

(60) Provisional application No. 62/481,167, filed on Apr. 4, 2017.

(51) Int. Cl.

| | |
|---|---|
| ***B65D 75/52*** | (2006.01) |
| ***B65D 75/26*** | (2006.01) |
| ***B65D 37/00*** | (2006.01) |

(52) U.S. Cl.

CPC ..... *B65D 75/52* (2013.01); *B65D 37/00* (2013.01); *B65D 75/26* (2013.01)

(58) Field of Classification Search

CPC ..... B65D 57/00; B65D 65/02; B65D 65/04; B65D 65/10; B65D 31/16; B65D 33/02; B65D 75/004; B65D 75/26; B65D 75/52; B65D 75/525; B65D 75/002

USPC ..... 383/3, 119; 229/9.1, 9.2, 9.3

See application file for complete search history.

(56) References Cited

U.S. PATENT DOCUMENTS

| | | | | |
|---|---|---|---|---|
| 4,076,121 | A | 2/1978 | Clayton et al. | |
| 4,288,965 | A | 9/1981 | James et al. | |
| 4,532,753 | A | 8/1985 | Kovacs | |
| 4,903,841 | A | 2/1990 | Ohsima et al. | |
| 4,965,126 | A | 10/1990 | Abraham et al. | |
| 5,139,832 | A | 8/1992 | Hayashi | |
| 5,229,180 | A | 7/1993 | Littmann | |
| 5,352,043 | A | 10/1994 | Takagaki et al. | |
| 5,984,088 | A * | 11/1999 | Dietz | A61F 15/001 206/205 |
| 6,149,227 | A | 11/2000 | Wycech | |
| 6,520,333 | B1 * | 2/2003 | Tschantz | B65D 81/052 206/522 |
| 6,729,112 | B2 | 5/2004 | Kuss et al. | |

(Continued)

FOREIGN PATENT DOCUMENTS

| | | |
|---|---|---|
| CN | 1301289 A | 6/2001 |
| CN | 1309067 A | 8/2001 |

(Continued)

OTHER PUBLICATIONS

Search Report and Written Opinion for PCT/US2018/025132 dated Jun. 19, 2018.

(Continued)

*Primary Examiner* — Jes F Pascua
*Assistant Examiner* — Nina K Attel
(74) *Attorney, Agent, or Firm* — Daniel S. Albrecht

(57) ABSTRACT

Flexible packages with reinforcing lines and flat panels.

16 Claims, 3 Drawing Sheets

(56) References Cited

U.S. PATENT DOCUMENTS

| | | | | |
|---|---|---|---|---|
| 7,448,495 | B2 * | 11/2008 | Sadow | A45C 13/02 206/320 |
| 9,403,617 | B2 | 8/2016 | Schneider et al. | |
| 9,695,586 | B1 | 7/2017 | Reading | |
| 9,908,285 | B2 | 3/2018 | Nam | |
| 10,151,304 | B2 | 12/2018 | Felton et al. | |
| 10,549,896 | B2 | 2/2020 | O'donnell | |
| 10,562,684 | B2 | 2/2020 | Exner et al. | |
| 10,926,930 | B2 | 2/2021 | O'donnell et al. | |
| 2001/0005979 | A1 | 7/2001 | Kuss et al. | |
| 2002/0006485 | A1 | 1/2002 | Bening et al. | |
| 2002/0094434 | A1 | 7/2002 | Zhou et al. | |
| 2003/0002755 | A1 | 1/2003 | Kim et al. | |
| 2004/0058118 | A1 | 3/2004 | Fink | |
| 2005/0147329 | A1 | 7/2005 | Arvizu | |
| 2005/0152624 | A1 | 7/2005 | Versluys | |
| 2005/0199692 | A1 | 9/2005 | Nelson et al. | |
| 2007/0184238 | A1 | 8/2007 | Hockaday et al. | |
| 2007/0251942 | A1 | 11/2007 | Cole et al. | |
| 2008/0011753 | A1 | 1/2008 | Browne | |
| 2008/0233320 | A1 | 9/2008 | Fink et al. | |
| 2008/0272117 | A1 | 11/2008 | Roos et al. | |
| 2009/0047477 | A1 | 2/2009 | Roys et al. | |
| 2009/0200294 | A1 | 8/2009 | Maxwell et al. | |
| 2009/0311190 | A1 | 12/2009 | Gracias | |
| 2010/0159218 | A1 | 6/2010 | Yum | |
| 2010/0260941 | A1 | 10/2010 | Bushmire et al. | |
| 2010/0291352 | A1 | 11/2010 | Jager | |
| 2010/0301512 | A1 | 12/2010 | Rousseau | |
| 2010/0326985 | A1 | 12/2010 | Lin | |
| 2011/0038571 | A1 | 2/2011 | Moehlenbrock | |
| 2011/0052106 | A1 | 3/2011 | Holmes et al. | |
| 2011/0097019 | A1 | 4/2011 | Moehlenbrock et al. | |
| 2011/0135884 | A1 | 6/2011 | Lettow et al. | |
| 2011/0176753 | A1 | 7/2011 | Nowak et al. | |
| 2011/0203229 | A1 | 8/2011 | Exner et al. | |
| 2012/0135237 | A1 | 5/2012 | Gracias | |
| 2012/0230614 | A1 | 9/2012 | Reichert et al. | |
| 2012/0306189 | A1 | 12/2012 | Stewart et al. | |
| 2013/0045530 | A1 | 2/2013 | Gracias | |
| 2013/0095258 | A1 | 4/2013 | Gracias | |
| 2013/0195382 | A1 | 8/2013 | Murray | |
| 2013/0210148 | A1 | 8/2013 | Gracias | |
| 2013/0292049 | A1 | 11/2013 | Schindler, II | |
| 2014/0033655 | A1 * | 2/2014 | Stanley | B65B 1/02 53/456 |
| 2014/0117588 | A1 | 5/2014 | Schindler, II et al. | |
| 2014/0199002 | A1 | 7/2014 | Murray | |
| 2014/0224697 | A1 | 8/2014 | Oostwouder et al. | |
| 2014/0305036 | A1 | 10/2014 | Pretsch | |
| 2014/0318591 | A1 | 10/2014 | Shelby et al. | |
| 2015/0059288 | A1 | 3/2015 | Wu | |
| 2015/0122842 | A1 * | 5/2015 | Berg, Jr. | B65D 75/008 222/173 |
| 2015/0266639 | A1 | 9/2015 | Mcdonald et al. | |
| 2015/0284144 | A1 | 10/2015 | Dytchkowskyj | |
| 2015/0307264 | A1 | 10/2015 | Boswell et al. | |
| 2016/0040657 | A1 | 2/2016 | Felton et al. | |
| 2016/0107812 | A1 | 4/2016 | Exner et al. | |
| 2016/0137374 | A1 | 5/2016 | Brosch | |
| 2016/0152402 | A1 | 6/2016 | Su | |
| 2016/0176584 | A1 | 6/2016 | Ishihara et al. | |
| 2016/0207704 | A1 | 7/2016 | Schneider | |
| 2016/0297589 | A1 | 10/2016 | You et al. | |
| 2017/0259961 | A1 | 9/2017 | O'Donnell et al. | |
| 2017/0259971 | A1 | 9/2017 | O'Donnell et al. | |
| 2017/0259972 | A1 | 9/2017 | O'Donnell et al. | |
| 2018/0317314 | A1 | 11/2018 | Olberding | |
| 2018/0339822 | A1 | 11/2018 | O'donnell et al. | |
| 2018/0339823 | A1 | 11/2018 | Rogers | |
| 2018/0339832 | A1 | 11/2018 | O'donnell et al. | |

FOREIGN PATENT DOCUMENTS

| | | | |
|---|---|---|---|
| CN | 1319539 | A | 10/2001 |
| CN | 2855927 | Y | 1/2007 |
| CN | 101663209 | A | 3/2010 |
| CN | 202686913 | U | 1/2013 |
| CN | 102991835 | A | 3/2013 |
| CN | 103108808 | A | 5/2013 |
| CN | 103803174 | A | 5/2014 |
| CN | 105916775 | A | 8/2016 |
| CN | 105934390 | A | 9/2016 |
| EP | 0620156 | | 10/1994 |
| EP | 0681970 | | 11/1995 |
| EP | 0997391 | | 5/2000 |
| EP | 1059243 | A2 | 12/2000 |
| EP | 1454837 | A1 | 9/2004 |
| EP | 1970310 | B1 | 11/2009 |
| EP | 2156947 | A1 | 2/2010 |
| EP | 2360099 | B1 | 7/2015 |
| FR | 2990686 | A3 | 5/2012 |
| JP | H09272564 | A | 10/1997 |
| JP | 2004299779 | | 10/2004 |
| WO | WO2017156367 | A1 | 9/2017 |

OTHER PUBLICATIONS

All Office Actions for U.S. Appl. No. 15/988,035.
All Office Actions for U.S. Appl. No. 15/988,021.
All Office Actions for U.S. Appl. No. 15/987,989.
All Office Actions, U.S. Appl. No. 16/718,924.
Davis, D. et al., "Self-folding of polymer sheets using microwaves and graphene ink," Royal Society of Chemistry Advances, 5, pp. 89254-89261 (Oct. 15, 2015).
Definition of While, Merriam-Webster Dictionary, retrieved from URL https://www.merriam-webster.com/dictionary/while on Apr. 24, 2020 (Year: 2020).
Liu, Y., et al., "Three-dimensional folding of pre-strained polymer sheets via absorption of laser light," American Institute of Physics, J. of Applied Physics, vol. 115, No. 20, pp. 204911-1-204911-6 (May 28, 2014).
Picnic Basket Buying Guide, available online by Apr. 23, 2016, retrieved from URL https://web.archive.org/web/20160423090801/https://www.thepicnicworld.com/picnic-basket-buying-guide/ on Apr. 23, 2020 (Year: 2016).
U.S. Appl. No. 17/150,073, filed Jan. 15, 2021, to O'Donnell Hugh Joseph et. al.

* cited by examiner

FLEXIBLE PACKAGES WITH FLAT PANELS

FIELD

The present disclosure relates in general to flexible packages and in particular to flexible packages with flat panels.

BACKGROUND

Packages for consumer products often have external artwork that includes graphics, such as images and branding. However, there are certain challenges to effectively displaying such graphics. Flexible packages are prone to wrinkling, which can cause artwork on the packages to have a poor appearance.

DETAILED DESCRIPTION

Flexible packages of the present disclosure include reinforcing lines that at least assist in reducing the wrinkling of flexible materials and improving the flatness of package panels, such that the packages have an improved appearance.

Figure 1:
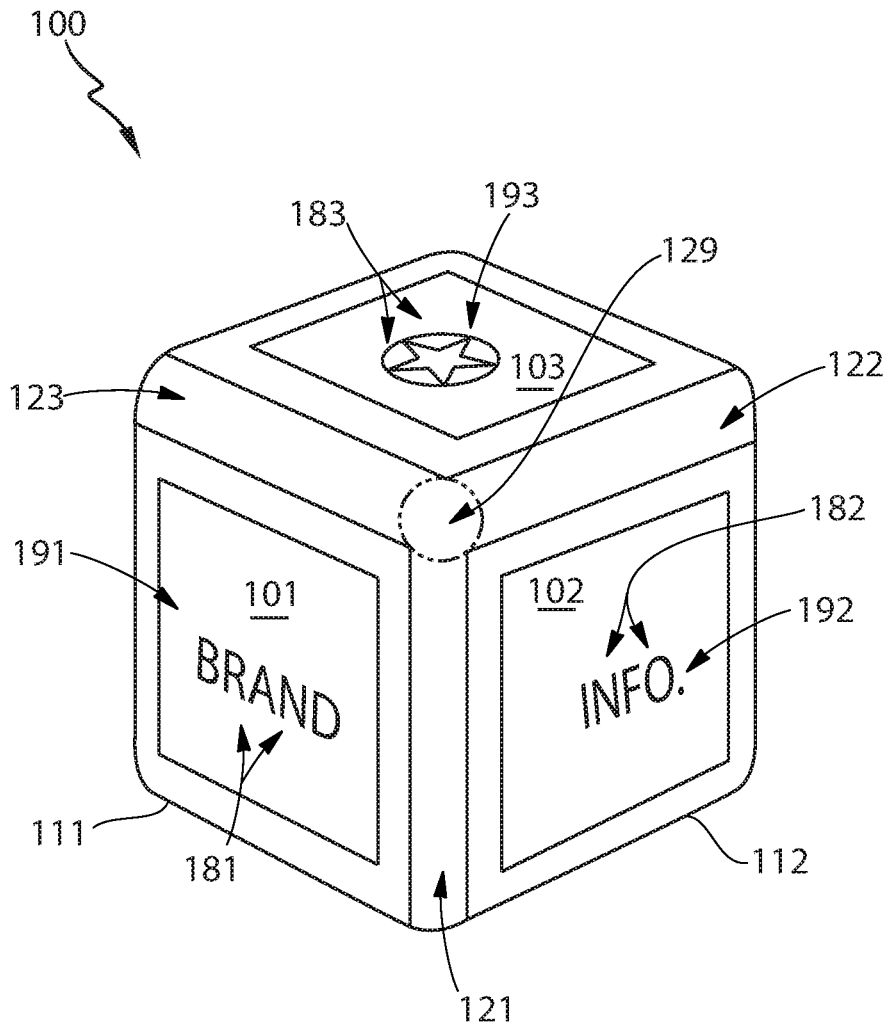
FIG. 1 illustrates an isometric view of a flexible package with straight reinforcing lines.

FIG. 1 illustrates an isometric view of a flexible package 100, having an overall shape similar to a cuboid, standing upright on a horizontal support surface (not shown). The package 100 includes a first panel 101, a second panel 102, and a third panel 103.

The first panel 101 is made from one or more flexible materials, forms a side of the package 100, and is about flat. The panel 101 has an overall shape like a square and includes a plurality of outer edges, which together form a periphery of the panel 101. Four reinforcing lines 111 are disposed on an exterior of the panel 101, around the entire periphery of the panel 101, with the outer extents of the reinforcing lines 111 coinciding with the periphery. Each of the reinforcing lines 111 is continuous and straight, and all of the reinforcing lines 111 are continuously connected end-to-end, like a square shaped frame. On the exterior of the panel 101 a square shaped portion 181 of the panel 101 is disposed in the middle of the reinforcing lines 111; the portion 181 is free of reinforcing lines. The exterior of the panel 101 also includes a graphic that is branding 191 disposed on the portion 181.

The presence and location of the reinforcing lines 111 increases the stiffness of the first panel 101 and at least assists in controlling the shape of the flexible material(s) that form the first panel 101. In particular, the reinforcing lines 111 reduce buckling and/or wrinkling in the flexible material(s), more clearly define the overall shape of the first panel 101, and contribute to improved flatness in the portion 181. As a result, the first panel 101 has a better appearance and the branding 191 on the portion 181 is more easily recognized. And, since the reinforcing lines 111 only cover a portion of the first panel 101, the reinforcing lines 111 are a more economical alternative than all-over printing or the use of thicker flexible material(s). These same benefits can be similarly realized on other panels of flexible materials with reinforcing lines, such as the second panel 102 and the third panel 103.

The second panel 102 is made from the one or more flexible materials, forms another side of the package 100, is square shaped and about flat, and has four continuous, straight reinforcing lines 112 disposed on its exterior and continuously connected end-to-end around its entire periphery, with a portion 182 free of reinforcing lines disposed in the middle, wherein the second panel 102 includes a graphic that is information 192 disposed on the portion 182. The reinforcing lines 112 provide increased stiffness and control of the flexible material(s), such that the second panel 102 has a better appearance and the information 192 on the portion 182 is more easily understood.

The third panel 103 is made from the one or more flexible materials, forms a top of the package 100, is square shaped and about flat, and has four continuous, straight reinforcing lines 113 disposed on its exterior and continuously connected end-to-end around its entire periphery, with a portion 183 free of reinforcing lines disposed in the middle, wherein the third panel 103 includes a graphic that is a logo 193 disposed on the portion 183. The reinforcing lines 113 provide increased stiffness and control of the flexible material(s), such that the third panel 103 has a better appearance and the logo 193 on the portion 183 is more easily perceived.

The first panel 101 and the second panel 102 are disposed on adjacent faces of the package 100, such that the first panel 101 and the second panel 102 are angled with respect to each other. On the first panel 101, of the reinforcing lines 111, the vertically oriented reinforcing line that is closest to the second panel 102 is disposed along an inboard edge of the first panel 101. On the second panel 102, of the reinforcing lines 112, the vertically oriented reinforcing line that is closest to the first panel 101 is disposed along an inboard edge of the second panel 102. These vertically oriented reinforcing lines, which are disposed along the inboard edges, are parallel with each other.

In between these vertically oriented reinforcing lines is a first radiused edge 121, made from the one or more flexible materials. The first radiused edge 121 is free of any reinforcing lines, such as the reinforcing lines 111 and 112. Since the first radiused edge 121 is free of any reinforcing lines, the flexible material(s) are allowed to bend around the angle between the first panel 101 and the second panel 102 without resistance from a stiffening structure. As a result, the first radiused edge 121 has an overall shape that is continuously curved between the first panel 101 and the second panel 102. The flexible material(s) of the first radiused edge 121 can have a smooth surface even while bending with a relatively tight radius. As a result, the first radiused edge 121 is attractive and well defined. These same benefits can be similarly realized on other radiused edges of flexible materials that are free of reinforcing lines, such as a second radiused edge 122 and a third radiused edge 123.

The second panel 101 and the third panel 103 are disposed on adjacent faces of the package 100, and are angled with respect to each other, with their closest reinforcing lines parallel with each other, and the second radiused edge 122 disposed in between, wherein the second radiused edge 122 is free of reinforcing lines, such that the second radiused edge 122 is attractive and well defined.

The first panel 101 and the third panel 103 are disposed on adjacent faces of the package 100, and are angled with respect to each other, with their closest reinforcing lines parallel with each other, and the third radiused edge 123 disposed in between, wherein the third radiused edge 123 is free of reinforcing lines, such that the third radiused edge 123 is attractive and well defined.

The first radiused edge 121, the second radiused edge 122, and the third radiused edge 123 all come together at a radiused corner 129, which is a vertex on the overall cuboid shape of the package 100. The corner 129 is disposed in between the corners of the first panel 101, the second panel 102, and the third panel 103, and is shown as the area encircled by a phantom line in FIG. 1. The radiused corner 129 is free of any reinforcing lines, such as the reinforcing lines 111, 112, and 113. Since the radiused corner 129 is free of any reinforcing lines, the flexible material(s) are allowed to bend around the angles between the first panel 101, the second panel 102, and the third panel 103 without resistance from a stiffening structure. As a result, the radiused corner 129 has an overall shape that is continuously curved between the first panel 101, the second panel 102, and the third panel 103. The flexible material(s) of the radiused corner 129 can have a smooth surface even while bending with relatively tight radii. As a result, the radiused corner 129 is attractive and well defined. These same benefits can be similarly realized on other radiused corners of flexible materials that are free of reinforcing lines.

Figure 2:
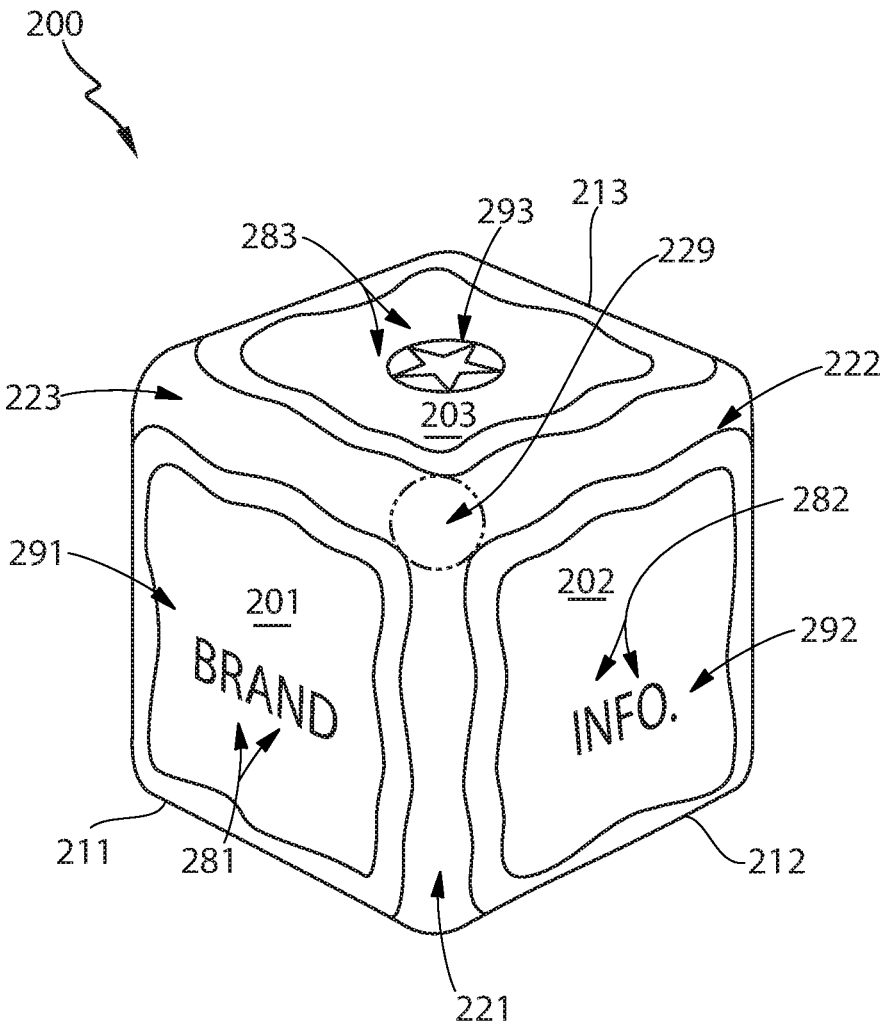
FIG. 2 illustrates an isometric view of a flexible package with non-linear reinforcing lines.

FIG. 2 illustrates an isometric view of a flexible package 200, which is the same as the flexible package 100, with the elements of FIG. 2 configured in the same way as like-numbered elements of FIG. 1, except as described below. Each of the reinforcing lines 211, 212, and 213 is non-linear but has a location and overall orientation that is about the same (respectively) as the location and orientation of the corresponding reinforcing line from the reinforcing lines 111, 112, and 113 of FIG. 1. Although the reinforcing lines 211, 212, and 213 are not straight, for the closest reinforcing lines on adjacent panels, the overall orientations of those reinforcing lines are parallel with each other (wherein each overall orientation is taken linearly from end-to-end). As a result, the panels 201, 202, and 203 experience the same benefits as the panels of FIG. 1, the radiused edges 221, 222, and 223 experience the same benefits as the radiused edges of FIG. 1, and the radiused corner 229 experiences the same benefits as the radiused corner of FIG. 1.

Figure 3:
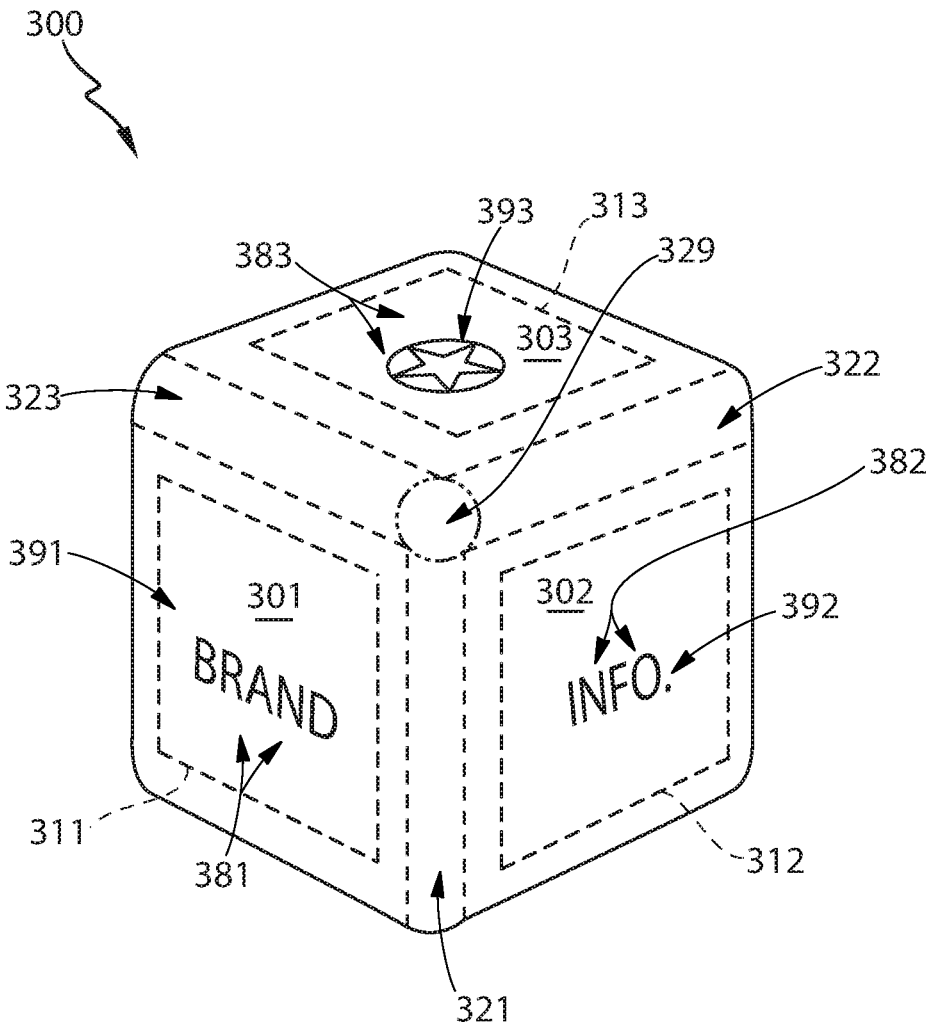
FIG. 3 illustrates an isometric view of a flexible package with interior reinforcing lines.

FIG. 3 illustrates an isometric view of a flexible package 300, which is the same as the flexible package 100, with the elements of FIG. 3 configured in the same way as like-numbered elements of FIG. 1, except as described below. Each of the reinforcing lines 311, 312, and 313 is disposed on the interior of its panel 301, 302, and 303 but otherwise has a location and orientation that is the same (respectively) as the location and orientation of the corresponding reinforcing line from the reinforcing lines 111, 112, and 113 of FIG. 1. As a result, the panels 301, 302, and 303 experience the same benefits as the panels of FIG. 1, the radiused edges 321, 322, and 323 experience the same benefits as the radiused edges of FIG. 1, and the radiused corner 329 experiences the same benefits as the radiused corner of FIG. 1.

Any of the embodiments disclosed herein may be created and/or modified according to any of the following, in any workable combination. A flexible package may have any size, shape, or configuration, including any number of panels, disposed at any relative angle from 1 degree to 180 degrees (wherein for 180 degrees, the panels are parallel with each other, disposed on opposite sides of the package), and configured according to any embodiment for a panel disclosed herein. Any panel may have any size, shape, or configuration, and may be made from one or more of any flexible materials disclosed herein or known in the art. Part, parts, or all of any panel may have varying degrees of flatness, and may be about flat, approximately flat, substantially flat, nearly flat, or completely flat, as defined and described herein. A flexible package may include any number of panels configured in the same way, or in similar ways, or in different ways, according to any embodiments disclosed herein.

Any reinforcing line may be formed in any way described herein or known in the art. Any reinforcing line may be made from one or more curable coatings, including photopolymers such as mixtures of monomers, oligomers, and/or photoinitiators; common forms include acrylates and silicones; such photopolymers are curable into a hardened state by exposure to heat and/or light (visible and/or ultraviolet), as known in the art. In various embodiments, any reinforcing line may made from various polymers, such as thermoplastics and/or thermosets. Any reinforcing line may be disposed on a flexible material by any suitable process, such as: gravure printing, inkjet printing, screen printing, and flexographic printing; these processes may also be used to impart a smooth outer surface or a rough/textured outer surface to a reinforcing line. Any reinforcing line may be disposed of a flexible material directly or indirectly (e.g. onto a printed label or overwrap that is applied to the flexible package).

Part, parts, or all or any reinforcing line may have any size and/or shape described herein or known in the art. Part, parts, or all of a reinforcing line may have an overall height from 40 to 5000 microns, or any integer value for microns from 40 to 5000, or any range formed by any of these values, such as, 40-4000 microns, 1000-3000 microns, 2000-4000 microns, etc. Part, parts, or all of a reinforcing line may have one or more overall widths (wherein each overall width is measured linearly from side-to-side across the entire reinforcing line, at a particular point along the reinforcing line) from 1 to 25 millimeters, or any integer value for millimeters from 1 to 25, or any range formed by any of these values, such as 1-15 millimeters, 5-20 millimeters, 10-25 millimeters, etc. A reinforcing line may have an overall height and/or overall width that is uniform or varying along its length and/or across its width. A reinforcing line may have any convenient overall length (measured linearly from end-to-end, over the entire reinforcing line).

Reinforcing lines disposed along inboard edges of adjacent panels may or may not be parallel with each other. As examples, these reinforcing lines may have any relative orientation from 30 degrees out of parallel to completely parallel, or out of parallel by any integer value for degrees from 1 to 30 degrees, or any range formed by any of these values, such as within 20 degrees of parallel, within 10 degrees of parallel, or within 5 degrees of parallel.

Reinforcing lines may be disposed in various ways and to various extents on a panel made from flexible material(s). Some or all of the reinforcing lines may not be continuously connected together and/or the reinforcing lines may be provided in multiple sections and/or part, parts, or all of one or more of the reinforcing lines may be discontinuous. One or more reinforcing lines may be disposed on the panel along 50 to 100% of the periphery of the panel, or any integer value for percentage between 50 and 100, such as 60-100%, 70-100%, 80-100%, or 90-100%. Reinforcing lines may be disposed along the entire periphery of the panel. The reinforcing lines disposed on a panel may cover 1 to 35% of the total surface area of the panel, or any integer value for percentage between 1 and 35, such as 1-27%, 1-21%, 1-15%, 1-10%, 10-27%, 15-20%, 10-35%, 15-35%, 21-35%, or 27-35%.

For any portion of a flexible package described as free of reinforcing lines, in various alternative embodiments, some limited presence of reinforcing lines may be included on that portion, as described below. Such portions may include: part, parts, or all of a radiused edge between panels; part, parts, or all of a radiused corner between panels; and/or part, parts, or all of a portion of a panel in the middle of reinforcing lines disposed along the periphery of the panel. One or more reinforcing lines may be disposed on such portions, so long as such portions are 75 to 100% free of reinforcing lines, or any integer value for percentage between 75 and 100, such as 80-100% free, 85-100% free, 90-100% free, or 95-100% free. Such portions may also be completely free of any reinforcing lines (and/or free of other reinforcing elements).

Definitions

As used herein, when the term "about" modifies a particular value, the term refers to a range equal to the particular value, plus or minus twenty percent (+/−20%). For any of the embodiments disclosed herein, any disclosure of a particular value, can, in various alternate embodiments, also be understood as a disclosure of a range equal to about that particular value (i.e. +/−20%). As used herein, when the term "about" refers to the straightness of a reinforcing line, the phrase "about straight" means that, when the reinforcing line is removed from a package (as defined herein) and laid out flat on a clean, smooth, flat horizontal surface (like a desktop), the reinforcing line fits side-to-side between two flat parallel lines set apart by a separation distance that is equal to the average overall width of the reinforcing line plus 20% of the overall length of the reinforcing line. As used herein, when the term "about" refers to the flatness of a panel, the phrase "about flat" means that, when the panel is part of a package configured for retail sale and is otherwise undistorted, the panel fits between two parallel planes set apart by a separation distance that is equal to the average overall thickness of the panel plus 20 millimeters.

As used herein, when the term "approximately" modifies a particular value, the term refers to a range equal to the particular value, plus or minus fifteen percent (+/−15%). For any of the embodiments disclosed herein, any disclosure of a particular value, can, in various alternate embodiments, also be understood as a disclosure of a range equal to approximately that particular value (i.e. +/−15%). As used herein, when the term "approximately" refers to the straightness of a reinforcing line, the phrase "approximately straight" means that, when the reinforcing line is removed from a package (as defined herein) and laid out flat on a clean, smooth, flat horizontal surface (like a desktop), the reinforcing line fits side-to-side between two flat parallel lines set apart by a separation distance that is equal to the average overall width of the reinforcing line plus 15% of the overall length of the reinforcing line. As used herein, when the term "approximately" refers to the flatness of a panel, the phrase "approximately flat" means that, when the panel is part of a package configured for retail sale and is otherwise undistorted, the panel fits between two parallel planes set apart by a separation distance that is equal to the average overall thickness of the panel plus 15 millimeters.

As used herein, the term "flexible package" refers to a package, wherein one or more flexible materials form from 50 to 100% of the total mass of the package, or any integer value for percentage from 50 to 100, or any range formed by any of these values, such as 50-88%, 50-80%, 50-70%, 50-63%, 63-88%, 70-80%, 63-100%, 70-100%, 80-100%, or 88-100% of the total mass of the package.

As used herein, the term "flexible material" refers to a thin, easily deformable, sheet-like material, having a flexibility factor within the range from 1,000 to 2,500,000 N/m, or any integer value for N/m from 1,000 to 2,500,000, or any range formed by any of these values, such as 1,000 to 1,250,500 N/m, 100,000 to 1,250,500, 1,250,500-2,500,000 N/m, etc. Examples of materials that can be flexible materials include one or more of any of the following: films (such as plastic films), elastomers, foamed sheets, foils, fabrics (including wovens and nonwovens), biosourced materials, and papers, in any configuration, as separate material(s), or as layer(s) of a laminate, or as part(s) of a composite material, in a microlayered or nanolayered structure, with or without one or more of any suitable additives (such as perfumes, dyes, pigments, particles, agents, actives, fillers, etc.) and in any combination, as described herein or as known in the art.

As used herein, the term "flexibility factor" refers to a material parameter for a thin, easily deformable, sheet-like material, wherein the parameter is measured in Newtons per meter, and the flexibility factor is equal to the product of the value for the Young's modulus of the material (measured in Pascals) and the value for the overall thickness of the material (measured in meters).

As used herein, the term "graphic" refers to a visual representation of an element intended to provide a decoration or to communicate information. Examples of graphics include one or more of any of the following: colors, patterns, designs, images (e.g. photographs, drawings, or other renderings), characters, branding, logos, information, and the like. For any embodiment disclosed herein (including any alternative embodiments), any surface of the package, including any panel(s), can include one or more graphics of any size, shape, or configuration, disclosed herein or known in the art, in any combination.

As used herein, the term "like-numbered" refers to similar alphanumeric labels for corresponding elements, as described below. Like-numbered elements have labels with the same last two digits; for example, one element with a label ending in the digits 20 and another element with a label ending in the digits 20 are like-numbered. Like-numbered elements can have labels with differing leading digit(s), wherein that leading digit(s) matches the number for its Figure; as an example, an element of FIG. 1 labeled 121 and an element of FIG. 2 labeled 221 are like-numbered.

As used herein, when referring to a reinforcing line the term "reinforcing line" refers to a defined structure disposed in or on a flexible material and having an overall pathway length that is at least five (5) times its widest overall width along that pathway length. Part, parts, or all of any reinforcing line can be straight, curved, angled, segmented, or other shapes, or any combination or any of these. In various embodiments, a reinforcing line can be formed by a unitary, continuous pathway or can be approximated by a number of discrete and/or separate portions disposed in series along a pathway. A reinforcing line may be disposed on an exterior of a flexible material on an outward facing surface of the package, or a reinforcing line may be disposed interior to a flexible material on an inward facing surface of the package; when disposed interior to a flexible material, the reinforcing line may be disposed within a flexible material (e.g. embedded), may be disposed in between multiple flexible materials that are connected over their faces (e.g. a laminate), or may be disposed between multiple flexible materials that are not connected over their faces (e.g. disposed interior to one flexible material, but exterior to another flexible material).

As used herein, the term "removed from the package" means removing a reinforcing line from a flexible package according to the description in this paragraph. Removal includes cutting out (e.g. by using scissors) a continuous portion of the package that includes the reinforcing line. The cutting out must not damage the portion in any way and also must not deform the portion in any way that would permanently distort its shape or limit its ability to lay flat. The removal must entirely separate the continuous portion from the rest of the package. The continuous portion of the package must include all of the reinforcing line that is being measured. The continuous portion of the package must not include any structural features besides the reinforcing line and the flexible material(s). The flexible material within the continuous portion must not include any discontinuities from the package structure such as creases, seams, seals, joints, weld lines, or the like. The continuous portion must include portions of the flexible material(s) directly attached to the reinforcing line as well as the adjoining portions of the flexible material(s) that surround the reinforcing line. The surrounding portions must extend 5-20 millimeters away from the reinforcing line, in all directions, unless there is an obstruction (such as a structural feature or discontinuity in the film) that is less than 5 millimeters away from the reinforcing line, in which case the surrounding portion should be cut as close to the obstruction as possible, without including any part of the obstruction. The continuous portion must be cut so that the cut edge is clean, smooth, and continuous, without any sharp corners, rough breaks, or ragged edges. If, during removal, a section of flexible material naturally separates (e.g. falls off) from the portion with the reinforcing line, then the separated section is discarded and not included in any measurement or assessment of the reinforcing line.

As used herein, when the term "nearly" modifies a particular value, the term refers to a range equal to the particular value, plus or minus five percent (+/−5%). For any of the embodiments disclosed herein, any disclosure of a particular value, can, in various alternate embodiments, also be understood as a disclosure of a range equal to approximately that particular value (i.e. +/−5%). As used herein, when the term "nearly" refers to the straightness of a reinforcing line, the phrase "nearly straight" means that, when the reinforcing line is removed from a package (as defined herein) and laid out flat on a clean, smooth, flat horizontal surface (like a desktop), the reinforcing line fits side-to-side between two flat parallel lines set apart by a separation distance that is equal to the average overall width of the reinforcing line plus 5% of the overall length of the reinforcing line. As used herein, when the term "nearly" refers to the flatness of a panel, the phrase "nearly flat" means that, when the panel is part of a package configured for retail sale and is otherwise undistorted, the panel fits between two parallel planes set apart by a separation distance that is equal to the average overall thickness of the panel plus 5 millimeters.

As used herein, the term "panel of flexible material" refers to a portion of an outside surface of a flexible package, wherein the portion is bounded by folds, curves, seams, and/or edges, such that the bounded portion is configured to substantially face a particular overall direction. Any of the embodiments of reinforcing lines can be disposed on one or more of any panels of any package disclosed herein or known in the art, including a front panel, a back panel, a side panel, a top panel, and a bottom panel.

As used herein, when referring to a packages for retail sale, the term "configured for retail sale" refers to a package that is fully manufactured and its product space(s) is/are filled with product(s) and the package is fully closed and/or sealed and the package is in condition to be purchased by an end user (e.g. a consumer), through any sales and/or distribution channel, wherein the package has not been opened or unsealed, and wherein the product(s) in the package have not been put into its/their intended end use. Any package disclosed herein (including any alternative embodiments) can be configured for retail sale.

As used herein, when the term "substantially" modifies a particular value, the term refers to a range equal to the particular value, plus or minus ten percent (+/−10%). For any of the embodiments disclosed herein, any disclosure of a particular value, can, in various alternate embodiments, also be understood as a disclosure of a range equal to approximately that particular value (i.e. +/−10%). As used herein, when the term "substantially" refers to the straightness of a reinforcing line, the phrase "substantially straight" means that, when the reinforcing line is removed from a package (as defined herein) and laid out flat on a clean, smooth, flat horizontal surface (like a desktop), the reinforcing line fits side-to-side between two flat parallel lines set apart by a separation distance that is equal to the average overall width of the reinforcing line plus 10% of the overall length of the reinforcing line. As used herein, when the term "substantially" refers to the flatness of a panel, the phrase "substantially flat" means that, when the panel is part of a package configured for retail sale and is otherwise undistorted, the panel fits between two parallel planes set apart by a separation distance that is equal to the average overall thickness of the panel plus 10 millimeters.

The packages described herein, may be used across a variety of industries for a variety of products. For example, any embodiment of a package, as described herein may be used for receiving, containing, storing, and/or dispensing any product in the consumer products industry. Although the present disclosure describes its embodiments with respect to consumer products, they can also be similarly applied outside of the consumer products industry.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A flexible package for retail sale of a consumer product, the package comprising:

a first panel comprising one or more flexible materials, a first reinforcing line disposed inboard of a first radiused edge, and a second reinforcing line disposed inboard of a third radiused edge, wherein the first and second reinforcing lines are continuous, and wherein the first panel is about flat;

a second panel comprising the one or more flexible materials, a third reinforcing line disposed inboard of the first radiused edge, and a fourth reinforcing line disposed inboard of a second radiused edge, wherein the third and fourth reinforcing lines are continuous, wherein the second panel is about flat, wherein the second panel is disposed at an angle with respect to the first panel, and wherein the angle is not zero; and a third panel comprising the one or more flexible materials, a fifth reinforcing line disposed inboard of the second radiused edge, and a sixth reinforcing line disposed inboard of the third radiused edge, wherein the fifth and the sixth reinforcing lines are continuous, wherein the third panel is about flat, wherein the third panel is disposed at an angle with respect to the first panel and the second panel, and wherein the angle is not zero;

wherein the first radiused edge comprises the one or more flexible materials, wherein the first radiused edge is disposed between the first and third reinforcing lines, wherein the first radiused edge is continuously curved between the first panel and the second panel, and wherein the first radiused edge is substantially free of reinforcing lines;

wherein the second radiused edge comprises the one or more flexible materials, wherein the second radiused edge is disposed between the fourth and fifth reinforcing lines, wherein the second radiused edge is continuously curved between the second panel and the third panel, and wherein the second radiused edge is substantially free of reinforcing lines;

wherein the third radiused edge comprises the one or more flexible materials, wherein the third radiused edge is disposed between the second and sixth reinforcing lines, wherein the third radiused edge is continuously curved between the first panel and the third panel, and wherein the third radiused edge is substantially free of reinforcing lines;

wherein the first radiused edge, the second radiused edge, and the third radiused edge meet at a radiused corner, wherein the radiused corner has an overall shape that is continuously curved between the first panel, the second panel, and the third panel;

wherein the first, second, third, fourth, fifth, and sixth reinforcing lines have a height of about 40 to about 5000 microns; and wherein the first, second, third, fourth, fifth, and sixth reinforcing lines comprise a different material than the one or more flexible materials of the flexible package.

2. The flexible package of claim 1, wherein the first panel and the second panel are substantially flat.

3. The flexible package of claim 1, wherein the first, second, third, fourth, fifth, and sixth reinforcing lines are each substantially straight.

4. The flexible package of claim 1, wherein the first, second, third, fourth, fifth, and sixth reinforcing lines each have an overall width of about 1 millimeter to about 25 millimeters.

5. The flexible package of claim 1, wherein the first reinforcing line and the third reinforcing line are within 10 degrees of parallel to each other.

6. The flexible package of claim 1, wherein the first, second, third, fourth, fifth, and sixth reinforcing lines are disposed interior to the one or more flexible materials on an inside surface of the flexible package.

7. The flexible package of claim 1, wherein the first, second, third, fourth, fifth, and sixth reinforcing lines are disposed exterior to the one or more flexible materials on an outside surface of the flexible package.

8. The flexible package of claim 1, wherein the first, second, third, fourth, fifth, and sixth reinforcing lines comprise curable photopolymers.

9. The flexible package of claim 8, wherein the first, second, third, fourth, fifth, and sixth reinforcing lines have a height of about 50 to about 1000 microns.

10. A flexible package for retail sale of a consumer product, the package comprising:

a first panel comprising one or more flexible materials and a first plurality of outer edges which together form a periphery of the first panel, wherein the first panel is about flat, a first plurality of reinforcing lines disposed on the first panel coinciding with the first plurality of outer edges and along substantially all of the periphery of the first panel, and one or more graphics disposed on a portion of the exterior of the first panel, wherein the portion of the exterior of the first panel is about 75% to about 100% free of reinforcing lines;

a second panel comprising one or more flexible materials and a second plurality of outer edges which together form a periphery of the second panel, wherein the second panel is about flat, a second plurality of reinforcing lines disposed on the second panel coinciding with the second plurality of outer edges and along substantially all of the periphery of the second panel;

a third panel comprising one or more flexible materials and a third plurality of outer edges which together form a periphery of the third panel, wherein the third panel is about flat, a third plurality of reinforcing lines disposed on the third panel coinciding with the third plurality of outer edges and along substantially all of the periphery of the third panel;

a first radiused edge disposed between a portion of the periphery of the first panel and a portion of the periphery of the second panel, wherein the first radiused edge is continuously curved between the first panel and the second panel, and wherein the first radiused edge is substantially free of reinforcing lines;

a second radiused edge disposed between a portion of the periphery of the second panel and a portion of the periphery of the third panel, wherein the second radiused edge is continuously curved between the second panel and the third panel, and wherein the second radiused edge is substantially free of reinforcing lines; and a third radiused edge disposed between a portion of the periphery of the first panel and a portion of the periphery of the third panel, wherein the third radiused edge is continuously curved between the first panel and the third panel, and wherein the third radiused edge is substantially free of reinforcing lines;

wherein the first radiused edge, the second radiused edge, and the third radiused edge meet at a radiused corner, wherein the radiused corner has an overall shape that is continuously curved between the first panel, the second panel, and the third panel;

wherein the first, second, and third pluralities of reinforcing lines have a height of about 40 to about 5000 microns; and wherein the first, second, and third pluralities of reinforcing lines comprise a different material than the one or more flexible materials of the flexible package.

11. The flexible package of claim 10, wherein the first, second and third panels are substantially flat.

12. The flexible package of claim 10, wherein the first, second, and third pluralities of reinforcing lines are substantially linear.

13. The flexible package of claim 10, wherein the first, second, and third pluralities of reinforcing lines each have a width of about 1 millimeter to about 25 millimeters.

14. The flexible package of claim 10, wherein the portion of the exterior of the first panel is about 85% to about 100% free of reinforcing lines.

15. The flexible package of claim 10, wherein the portion of the exterior of the first panel is completely free of reinforcing lines.

16. The flexible package of claim 10, wherein the first, second, and third plurality of reinforcing lines comprise curable photopolymers.

* * * * *